US006224030B1

(12) United States Patent
Hepworth

(10) Patent No.: US 6,224,030 B1
(45) **Date of Patent: *May 1, 2001**

(54) HOOK/HANGER

(75) Inventor: Paul Steabben Hepworth, Guildford (GB)

(73) Assignee: Plasplugs, Inc., Lakewood, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/567,947

(22) Filed: May 10, 2000

Related U.S. Application Data

(62) Division of application No. 09/026,715, filed on Feb. 20, 1998, now Pat. No. 6,086,030.

(51) Int. Cl.[7] ..... A47B 96/06
(52) U.S. Cl. ..... 248/215; 248/322
(58) Field of Search ..... 248/215, 216.1, 248/227.1, 218, 217, 217.3, 304, 339, 340, 301, 914, 322

(56) References Cited

U.S. PATENT DOCUMENTS

| | | | |
|---|---|---|---|
| 254,333 | 2/1882 | Kane | 248/68.1 |
| 327,939 | 10/1885 | Garrison | 248/224.7 |
| 536,412 | 3/1895 | Wood | 248/304 |
| 576,058 | 1/1897 | Philbrick | 248/320 |
| 1,013,187 | 1/1912 | Butler et al. | 248/62 |
| 1,056,911 | 3/1913 | Kinzey | 248/215 |
| 1,580,354 | 4/1926 | Wallister | 248/215 |
| 2,470,878 | 5/1949 | Tate | 248/215 |
| 2,687,836 | 8/1954 | Rhodes et al. | 248/215 |
| 2,743,023 | 4/1956 | Larson | 211/96 |
| 3,372,439 | 3/1968 | Schmid | 24/484 |
| 4,039,136 | 8/1977 | DeHart | 248/215 |
| 4,417,712 | 11/1983 | DeHart | 248/225.2 |
| 4,466,591 | 8/1984 | Alonzo | 248/217.1 |
| 5,104,083 | 4/1992 | Shannon | 248/339 |
| 5,372,346 | 12/1994 | Upchurch et al. | 248/304 |
| 5,535,971 | 7/1996 | Adams | 248/215 |
| 5,553,823 | 9/1996 | Protz, Jr. | 248/304 |
| 5,782,447 | 7/1998 | Hoffand | 248/227.1 |
| 6,086,030 * | 7/2000 | Hepworth | 248/215 |

FOREIGN PATENT DOCUMENTS

| | | |
|---|---|---|
| 654476 | 2/1966 | (CH) . |
| 9201931 | 5/1992 | (DE) . |
| 365734 * | 1/1932 | (GB) . |
| 0418152 | 10/1934 | (GB) . |
| 0654890 | 7/1951 | (GB) . |
| 0726884 | 3/1955 | (GB) . |
| 1016563 | 1/1966 | (GB) . |
| 1278118 | 6/1972 | (GB) . |
| 1349031 | 3/1974 | (GB) . |

* cited by examiner

*Primary Examiner*—Ramon O. Ramirez
*Assistant Examiner*—Kimberly Wood
(74) *Attorney, Agent, or Firm*—Michaelson & Wallace; Peter L. Michaelson

(57) ABSTRACT

A hook/hanger for use at the top of a door is formed in two separate parts in the form of a plastics material molding, having a flat rear surface and a central front hook-shaped part, and a sheet metal pressing which has a leg snap-fitting in a slot in the molding extending inwards from its top surface, in which is provided a recess to receive flush a body part of the pressing which engages the top surface of the door, in use. The body part has barbs to be driven into said door top surface to retain the hook/hanger in place. The pressing has a very small thickness to allow the door to be fully closed even with the hook in place.

23 Claims, 2 Drawing Sheets

Figure 1:
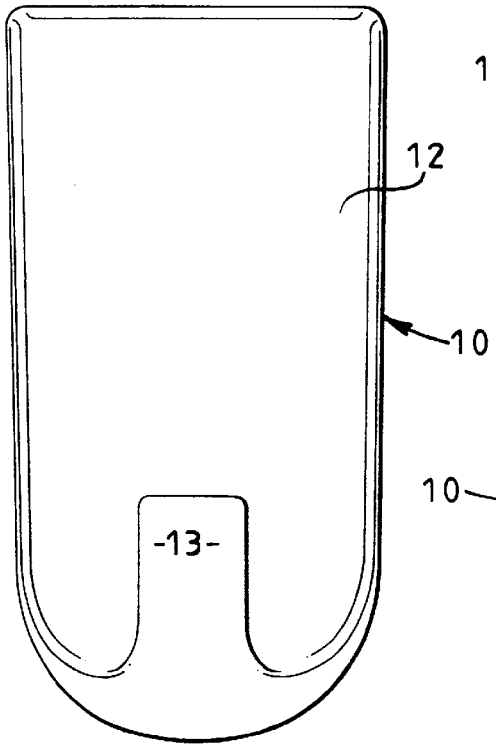

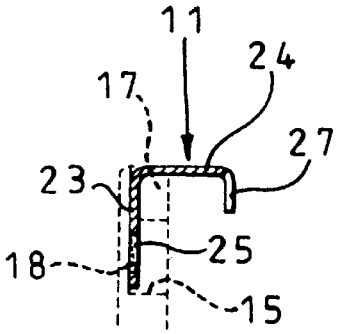
FIG 6
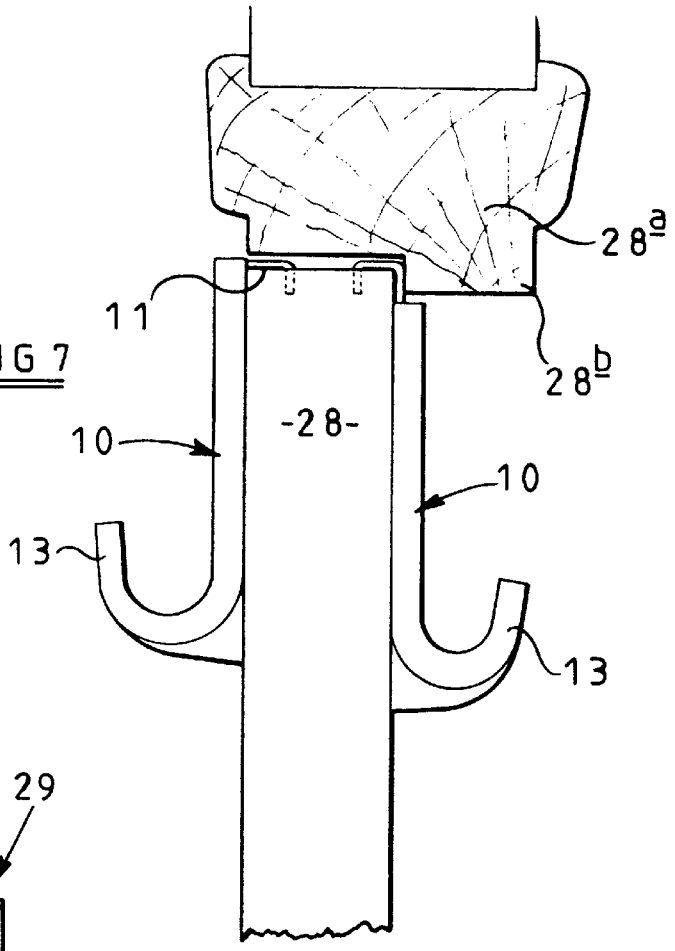
FIG 7
FIG 8
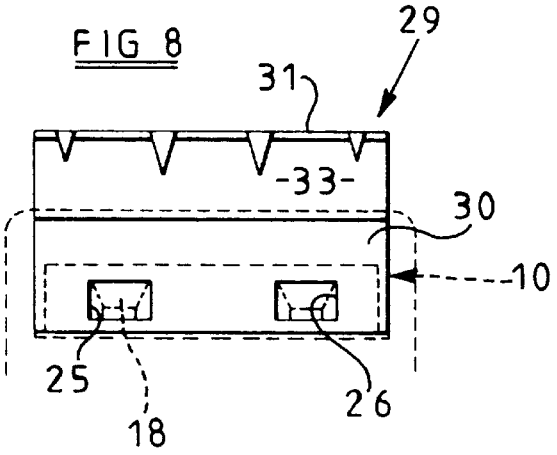
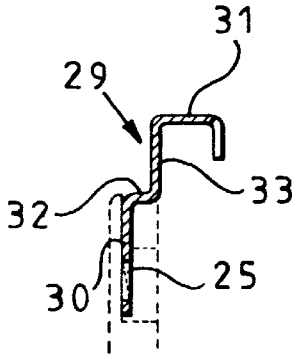
FIG 9

HOOK/HANGER

This application is a division of Ser. No. 09/026,715 filed Feb. 20, 1998, Provisional No. 6,086,030.

FIELD OF THE INVENTION

This invention relates to a hook/hanger, primarily for use at the top of a door.

BACKGROUND OF THE INVENTION

Various types of hooks for fitting at the top of a door are known. One type is a one-piece plastics material construction having a curved hook-shaped part depending from one limb of an inverted flattened U-shaped part, the flattened 'base' of the U-shape lying across the flat top surface of the door and the limbs of U-shape depending at and lying against respective opposite sides of the door. A problem with this construction is that the thickness of the plastics material base part is too great to allow the door fully to close, such base part engaging the door transom upon attempted closing. With the component needing to have a certain strength, it is not acceptable to reduce the thickness of the base part, even if this were possible with the material used.

Another type is also a one-piece plastics material construction and has only a single depending limb with a curved hook-shaped part depending therefrom. At the upper end of the limb, it is bent through 90° to provide a short straight leg which is intended to rest on the flat top surface of the door and be secured thereto by a nail or screw, through it. However again the thickness of the leg prevents the full closing of the door into its frame.

An object of the invention is to provide a hook/hanger in an effective and convenient form, and which preferably overcomes the disadvantages of the prior art. According to one embodiment the invention there is provided a hook/hanger for use at two adjacent, mutually angled first and second surfaces, the hook/hanger comprising separate first and second elements which connect, or are connected, together, the first element including at least one hook-shaped part or hanging means and being intended to be disposed at said first surface, and the second element being intended to be disposed at at least the second surface and being adapted to retain the hook/hanger in place, (when the hook is in use).

The hook/hanger is principally intended for use at the top of a pivotable door with said first and second surfaces being a side of the door and the top surface thereof respectively, the thickness of said second element being less than the space between the top of the door and the lower surface of the door frame transom, so that full closing of the door is possible with the hook/hanger in place.

DETAILED DESCRIPTION OF THE PRESENT INVENTION

Desirably the second element is a sheet metal pressing, whilst conveniently the first element is a plastics material injection moulded component. Advantageously a leg of the pressing is received in a slot at the top of the moulded component to connect the elements together. Desirably the connection is a snap-fit, more preferably by projections on the moulded component engaging in respective openings in the pressing.

Figure 2:
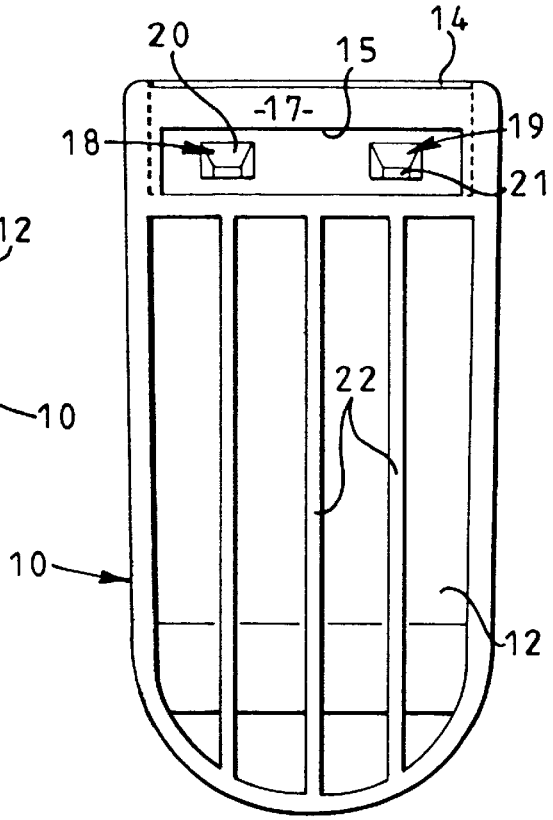
Figure 3:
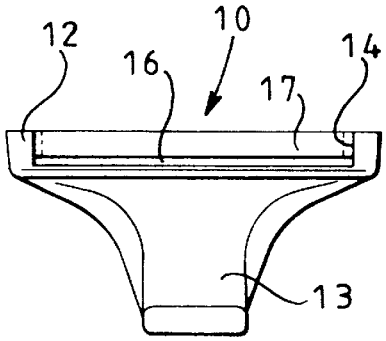
Figure 4:
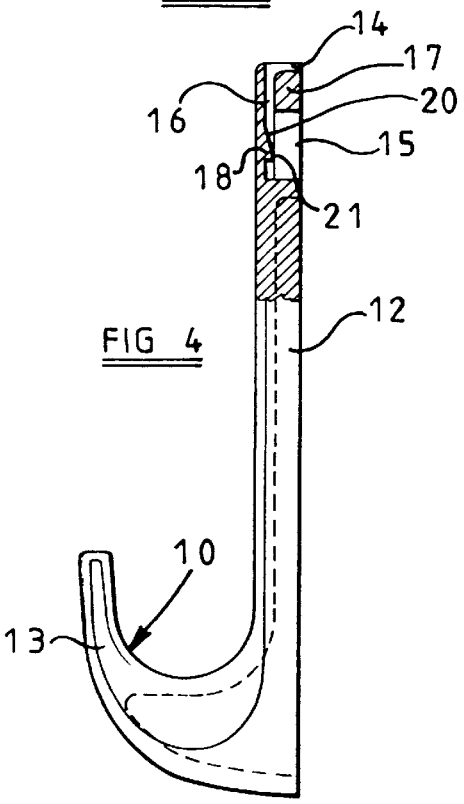
Figure 5:
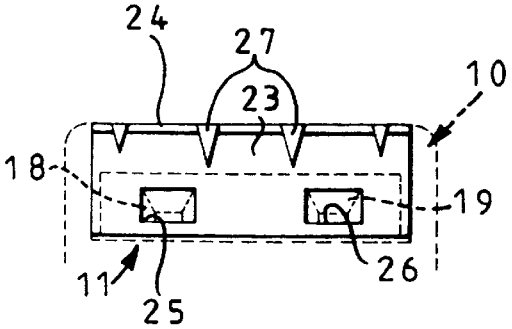

The invention will now be described, by way of example, with reference to the accompanying drawings, in which:

FIG. 1 is a front view of one element of a hook/hanger of a first embodiment of the invention, FIGS. 2 and 3 are a rear view and a top plan view respectively of said one element, FIG. 4 is a part-sectional side view of said one element, FIG. 5 is a rear view of a second element of a hook/hanger of said first embodiment of the invention, shown engaged with part of said one element, FIG. 6 is a side view of the second element, shown engaged with part of said one element, FIG. 7 is a schematic side view of a top part of a door and associated transom showing at one side of the door the hook/hanger of said first embodiment, and at the other side of the door a hook/hanger of a second embodiment of the invention, and FIGS. 8 and 9 are views corresponding to FIGS. 5 and 6, for the second element of the second embodiment of hook/hanger.

The present invention relates generally to a hook/hanger which can be used at two adjacent, mutually angled first and second surfaces. Normally these surfaces would be flat, and at 90° to one another, although the invention could have application to surfaces which are, for example, curved, and/or which are at an angle to each other different from 90°. The primary intended use of a hook/hanger of the invention is at the top of a conventional pivoted door. As described above, this type of door fitting is known, and generally the part of the fitting which extends over the side of the door has at its lower end a hook-shaped part so that, for example, in use a conventional coat hanger can be engaged thereon for hanging a garment or the like. Although it is also known to provide a series of upstanding stop pegs extending horizontally away from the part of the fitting at the side of the door, so as, in effect, to form more of a hanger than a hook, the term 'hook' will be used generally hereinafter for the item in question, it being understood that this is intended to cover arrangements which provide one or more conventional hook-shaped parts, or alternatively other retaining or stop means which facilitate a hanging from the fitting of, for example, an item of clothing, whether indirectly by way of a coat hanger, or directly by way of a garment tab/tag or the like. The term is also intended to cover a hook used in an arrangement where two such 'hooks' are spaced apart at the top of the door, with a hanging rail extending between the 'hooks' forwardly at the door surface, respective opposite ends of the rail being fitted in facing 'sockets' formed in respectively forwardly extending parts of the hooks. Thus one of the hooks could be considered to have the rail as a part thereof, or as its hanging means, if necessary.

A hook according to a first embodiment of the invention is formed in two parts, namely a plastics material moulding 10 and a sheet metal pressing 11, the two components being intended to be snap-fitted together to form the composite hook, as will be described hereinafter. As shown in FIGS. 1 to 4, the moulding 10 has a generally rectangular rear part 12 which has a generally flat back surface. Similarly the front surface of the part 12 is also generally flat, but at its lower end is shaped to form a forwardly and upwardly projecting hook-shaped part 13, the free end of which is spaced forwardly from the front surface of the part 12 and, having a much reduced width as compared to the width of the part 12, is disposed centrally of said part 12, as shown in FIG. 1 so that, in front view, and also as will be described in rear view, the moulding is symmetrical about its longitudinal centre line.

A rectangular recess 14 is formed in the top rear surface of the part 12, the recess extending only a short way longitudinally of the part 12 but extending over a considerable portion of its thickness, as best shown in FIG. 4. As shown in FIG. 2, the recess extends over substantially the whole of the width of the part 12, but terminates just short of each of the opposite sides thereof.

A further, lower, rectangular recess 15 is formed in the rear face of the part 12, as shown best in FIGS. 2 and 4, the recesses 14 and 15 lying parallel to one another, but with the recess 15 being of greater extent longitudinally than the recess 14. However the recess 15 is slightly less wide, as shown in FIG. 2, and extends through slightly less of the thickness of the part 12, as shown in FIG. 4. The two recesses, are however placed in communication by a rectangular slot 16 extending downwards from the inner end of the recess 14 to the level of the bottom of the further rectangular recess 15, as best shown in FIG. 4. The slot 16 has the same width as the recess 14. This arrangement of recesses and slot thus defines a cross-member 17 lying between the sides of the part 12 just below the top surface thereof.

At two places respectively symmetrically disposed at opposite sides of the longitudinal centre line of the part 12, the slot 16 is interrupted by a pair of projections 18, 19 respectively which project rearwardly to terminate at the interface between the slot 16 and the further rectangular recess 15, as shown in FIG. 4. Each projection has a downwardly sloping surface 20, which is also angled inwardly from its sides, as shown in FIG. 2, the surface 20 leading to a short surface 21 which is parallel to the flat front face of the part 12. The undersurface of the projection is perpendicular to the surface 21 and extends to the inner front face of the slot 16. The projections are arranged longitudinally of the part 12 so as to be disposed centrally of the longitudinal extent of the further recess 15, as best shown in FIG. 2.

As mentioned, the moulding is of plastics material, for example ABS or polypropylene, and the production method is preferably by means of injection moulding. Typically the thickness of the main rectangular portion of the rear part 12 would be of the order of 6.5 mm, and as will be described, this is generally greater than the space which is normally formed between the upper surface of a conventional pivoted door and the associated transom above it. Finally with regard to the moulding 10, it can be seen from FIG. 4 that in the back surface of the part 12, material can be removed to define ribs 22. However the outer peripheral surface at least would lie in a common flat plane so that, in use, as will be described, the back surface of the part 12 can lie flat against one side of the door.

In the first embodiment of the invention, the sheet metal pressing 11 is in the form shown in FIGS. 5 and 6 where it is, in fact, shown engaged with an upper part of the moulding 10, this upper part being shown in dashed lines. As described, this second component of the hook is formed by pressing from a metallic sheet, for example Zintex. The sheet is relatively thin, particularly as compared to the thickness of the moulding 10, a typical thickness for the sheet being 1 mm.

The pressing is formed by bending the sheet through 90° to define a rectangular leg part 23 and a rectangular body or top part 24 at 90° thereto, both parts 23 and 24 being flat, it being intended that in use, the undersurface of the part 24 remote from the leg part 23 is disposed on the upper surface of the door, whilst the leg part 23 is received within the slot 16 in the moulding 10 in order to connect the two components of the hook together.

Disposed symmetrically at opposite sides of the centre line of the pressing are a pair of rectangular holes 25, 26 respectively which extend through the thickness of the metal sheet. There are positioned generally toward the bottom of the leg part 23 and this positioning, and the size of the holes is such that when the leg 23 is engaged in the slot 16, the projections 18, 19 respective snap-fittingly engage in the holes 25, 26, as schematically shown in FIGS. 5 and 6, to retain the leg in place and thus to connect the moulding 10 and the pressing 11 together. Finally it can be seen that at the end of the top part 24 remote from the leg part 23, the pressing is formed with a plurality of spaced barbs 27 which it is intended can be hammered into the top surface of the door so as to secure the pressing 11, and thus the hook, thereto.

Accordingly, as shown in FIG. 7, the hook, in use, can be fitted at the outside of a pivotally opening door 28 with the barbs 27 hammered or pushed down into the top of the door with the rear face of the moulding disposed against the outer side face of the door as shown to provide hook/hanger means at said side for the hanging, either directly or indirectly as described, of garments at the door. As described, the pressing 11 and moulding 10 are assembled together by inserting the leg part 23 downwardly into the lot 16. The initial insertion causes the free end of the leg part 23 slightly to compress the resilient projections 18, 19 until the leg part is pushed down sufficiently for these projections to spring back into the holes 25, 26 respectively as shown in FIGS. 5 and 6. In this position the portion of the top part 24 adjacent the leg part 23 will engage the top of the cross-member 17 so as to be received flush in the rectangular recess 14, the remaining rearwards portion of the top part 24 lying flat on the top of the door surface when the barbs have been hammered or pushed down into it.

Normally the hook would be supplied with the pressing and the moulding fitted together for fixing the assembled hook directly to a door, but it would be possible to supply the components unassembled and to fix the pressing to the door firstly and thereafter engage the moulding 10 with it, provided the correct positioning of the pressing was determined so that when the pressing and moulding are connected together, the rear face of the moulding lies tight against the outside surface of the door. This alternative is less desirable, not least due to the chance of possible injury during assembly by the sharp edge of the metal pressing.

As has already been described, the gap between the lower surface of a conventional transom 28*a* and the upper surface of the door 28 is normally very small and, as can be seen from FIG. 7, it much smaller than the thickness of the rear part 12. Accordingly the part of a known one piece plastics material hook which extends over the top of the door cannot be received in this space, so that, as described, the door cannot be fully closed when it carries such a hook. With the present invention, the separation of the hook into two parts with the part which is received at the top of the door being of greatly reduced thickness enables full closing of the door to be accomplished. Although, conveniently, the component at the upper surface of the door is of metal, this is not essential and it may be that the component equivalent to the pressing 11 could be of a non-metallic material. However the ability of a metallic pressing to provide both the required thinness with accompanying strength makes is particularly suitable, as well as being easy and relatively expensive to produce. With this arrangement the main part of the hook, i.e. that which is at the door surface, can still be of strong plastics material and formed in a decorative or other shape.

Although as described with barbs, possibly for a permanent fixing, the hook need not be permanently fixed to the door, and even with barbs it would be possible for pressing 11 to be removed after use. Alternatively the top part of the pressing could extend across the whole of the top surface of the door and be formed with a downwardly depending leg at its opposite free end, which would engage the other side of the door, thereby retaining the pressing or equivalent component in place without the need for fixing barbs or other fixing means. However with this construction a countersunk or other hole could be formed in the top part 24 for reception of a (headed) fixing screw, nail, panel pin or the like which would lie no higher than flush with the top surface of the top part 24 and would thus not interfere with the full closing of the door. The disadvantage of having the top part across the whole of the upper surface of the door, is that it would of course be necessary to ensure that the width of the top part corresponds to the thickness of the door with which the hook is intended to be used.

Instead of the projections and recess openings described to interconnect the two component of the hook, it will be appreciated that the connection/fixing together could be by any other convenient appropriate means. For example the bottom of the leg part 23 could merely be formed with bent up portions at respective opposite sides of its inner face, so that although these would be deformed when passing behind the cross-member 17, these portions would then spring back outwardly into the further recess 15 so as to engage therein and resist withdrawal upwardly of the pressing. Alternatively, however, it is envisaged that the connection could be permanent, for example by way of adhesive. It is clear that the hook/hanger could be supplied ready assembled, or with the two parts separated together with instructions for assembly.

It will be appreciated that the pressing could provide means along its width, if this were extended from that shown, for engagement by several components in the form of the moulding 10 or components equivalent thereto, and it is also envisaged that there could be a plurality of hooks which are arranged so as to cascade downwardly at the side of the door, either from different depending parts of the pressing or from one hook to another.

FIG. 7 also shows a second embodiment of a hook/hanger of the invention at the inside surface of the door. The difference here is that the door, in its fully closed position, fits in a rebate in the transom, so that, as shown, a projecting part 28*b* of the transom at the inside of the door frame extends downwardly below the top surface of the door. Thus if the top of the moulding 10 extends up to a position possibly slightly above the top surface of the door, as shown at the outside surface of the door in FIG. 7, such an arrangement at the inside surface would prevent the door fully closing. Accordingly an alternative form of pressing 11 is used in this instance, this being illustrated in FIGS. 8 and 9.

It can be seen that this alternative pressing 29 is of similar form as far as its leg part 30 is concerned, and the same numerals are used in respect thereof. The difference is that the barbed body or top part 31 is now joined to the leg part 30 by a spacing section in order to permit the top of the moulding 10 to lie sufficiently below the top surface of the door to accommodate the downward projecting part of the transom shown in FIG. 7. Accordingly extending inwardly from the top of the leg part 30 at right angles thereto is a short surface 32 which itself joins, at 90°, a longer upwardly extending surface 33 which joins the top part 31. The inwards extent of the short surface 32 allows the depending transom part to be accommodated when the door is fully closed with the hook in place, as shown in FIG. 7, whilst the length of the upwardly extending surface 33 is such as to position the top surface of the moulding 10 below the bottom surface of this depending transom part when the moulding 10 and pressing 29 are engaged together by way of the projections and holes respectively. Accordingly in essence the pressing is itself rebated to accommodate the depending transom part.

What is claimed is:

1. A hanger comprising:

a hook element having an upper surface, a front surface, a rear surface opposed to said front surface, a hook-shaped part located at a lower region of said hook element opposite said upper surface, and a groove formed in said hook element, said groove opening to said upper and rear surfaces, and said hook-shaped part having a free end spaced forwardly of said front surface;

a hanger bracket having a leg and a body fixed to said leg, said leg received in said groove and fixed to said hook element, and said body having a free end spaced rearwards of said rear surface; and a securing means mounted on said free end of said body for fixing said hanger bracket to an object.

2. The hanger of claim 1, wherein said groove is L-shaped and said hanger bracket is L-shaped, and said body extends from said groove along a plane flush with said upper surface.

3. The hanger of claim 2, wherein said securing means includes a gripping element extending below said plane of said upper surface.

4. The hanger of claim 3, wherein said gripping element includes at least one barb located below said plane of said upper surface.

5. The hanger of claim 2 further including connector means mounted in said groove for providing a snap-fit connection between said leg and said hook element upon sliding said leg into said groove.

6. The hanger of claim 5, wherein said connector means includes at least one resilient projection mounted in said groove, and said leg includes at least one opening coupled to said at least one resilient projection.

7. The hanger of claim 2, wherein the thickness of said hook element between said front and rear surfaces is substantially greater than the thickness of said hanger bracket.

8. The hanger of claim 7, wherein said hook element is formed from plastic.

9. The hanger of claim 8, wherein said hook element is formed by an injection molding process.

10. The hanger of claim 8, wherein said hanger bracket is metal.

11. The hanger of claim 10, wherein said hanger bracket is formed from a sheet metal pressing process.

12. The hanger of claim 7, wherein said hanger bracket has a thickness no greater than 1 mm.

13. A hanger assembly comprising:

a hanger support having first and second surfaces;

a hook element having an upper surface, a front surface, a rear surface opposed to said front surface, a hook-shaped part located at a lower region of said hook element opposite said upper surface, and a groove formed in said hook element, said groove opening to said upper and rear surfaces, and said hook-shaped part having a free end spaced forwardly of said front surface;

a hanger bracket having a leg and a body fixed to said leg, said leg received in said groove and fixed to said hook element, and said body having a free end spaced rearwards of said rear surface; and a securing element mounted on said free end of said body and fixed to said first surface such that said rear surface abuts said second surface.

14. The hanger assembly of claim 13, wherein said body extends from said groove along a plane flush with said upper surface while said body rests on said first surface, such that said upper surface lies in a plane above said first surface.

15. The hanger assembly of claim 14, wherein said groove is L-shaped and said hanger bracket is L-shaped, said securing means includes a gripping element extending below said body, and said gripping element grips said hanger support at said first surface.

16. The hanger assembly of claim 15, wherein said hanger support is a door, said first surface is a top horizontal surface of said door, said second surface is a vertical surface of said door, and said gripping element includes at least one barb embedded in said door at said top horizontal surface while said rear surface abuts said vertical surface of said door.

17. The hanger assembly of claim 16 further including an opening in said leg, and a connector means having at least one resilient projection mounted in said groove for providing a snap-fit connection with said opening upon sliding said leg into said groove.

18. The hanger assembly of claim 17, wherein the thickness of said hook element between said front and rear surfaces is substantially greater than the thickness of said hanger bracket.

19. The hanger assembly of claim 18, wherein said hook element is formed from plastic.

20. The hanger assembly of claim 19, wherein said hook element is formed by an injection molding process.

21. The hanger assembly of claim 19, wherein said hanger bracket is metal.

22. The hanger assembly of claim 21, wherein said hanger bracket is formed from a sheet metal pressing process.

23. The hanger assembly of claim 22, wherein said hanger bracket has a thickness no greater than 1 mm.

* * * * *